US005142340A

United States Patent [19]

Farrell et al.

[11] Patent Number: 5,142,340

[45] Date of Patent: Aug. 25, 1992

[54] FUSER CLEAN-UP PURGE SHEETS SYSTEM FOR DUPLEX REPRODUCTION APPARATUS

[75] Inventors: Michael E. Farrell, Fairport; William J. Moon, Marion, both of N.Y.

[73] Assignee: Xerox Corporation, Stamford, Conn.

[21] Appl. No.: 730,135

[22] Filed: Jul. 15, 1991

[51] Int. Cl.[5] ..... G03G 15/20

[52] U.S. Cl. ..... 355/283

[58] Field of Search ..... 355/282, 283, 284, 308, 355/319, 296; 219/216

[56] References Cited

U.S. PATENT DOCUMENTS

| | | | |
|---|---|---|---|
| 3,706,491 | 12/1972 | Furman et al. | 355/133 |
| 4,163,897 | 8/1979 | Hubbard et al. | 235/92 SB |
| 4,190,354 | 2/1980 | Smith et al. | 355/309 |
| 4,206,996 | 6/1980 | Clark et al. | 355/207 |
| 4,229,100 | 10/1980 | Travis | 355/77 |
| 4,327,993 | 5/1982 | Gauronski et al. | 355/207 |
| 4,402,599 | 9/1983 | Seto | 355/296 X |
| 4,920,382 | 4/1990 | Mills et al. | 355/284 |

FOREIGN PATENT DOCUMENTS

| | | | |
|---|---|---|---|
| 0266473 | 11/1988 | Japan | 355/283 |
| 0063085 | 3/1990 | Japan | 355/283 |

*Primary Examiner*—A. T. Grimley

*Assistant Examiner*—William J. Royer

[57] ABSTRACT

An improved fuser cleaning purge cycle system of cleaning imaging material from a fuser (particularly, a fuser roll) of a copy reproducing apparatus after an inadvertent interruption of the operation of the apparatus, such as by a paper jam, in which the fuser was potentially contaminated with imaging material from a copy sheet being fused, wherein the reproducing apparatus has an alternative duplex copying path; comprising, automatically, sequentially feeding a preset limited number of preexisting conventional clean copy sheets in the copy reproducing apparatus through the fuser to function as fuser cleaning sheets to remove the potentially contaminating imaging material, then feeding the same fuser cleaning sheets through the alternative duplex copying path back to and through the fuser a second time, with sheet inversion, so that they are inverted before feeding through the fuser the second time, and then purging these fuser cleaning sheets. The fuser cleaning cycle may be automatically initiated in response to sensing that a copy sheet was stopped in the fuser during the interruption of the operation of the reproducing apparatus. Preferably, the preset limited number of sheets used is four or less, yet, preferably, every area of the circumference of a fuser roll is contacted by at least one side of one fuser cleaning sheet a minimum of four times during this fuser cleaning cycle.

3 Claims, 2 Drawing Sheets

FUSER CLEAN-UP PURGE SHEETS SYSTEM FOR DUPLEX REPRODUCTION APPARATUS

Figure 1:
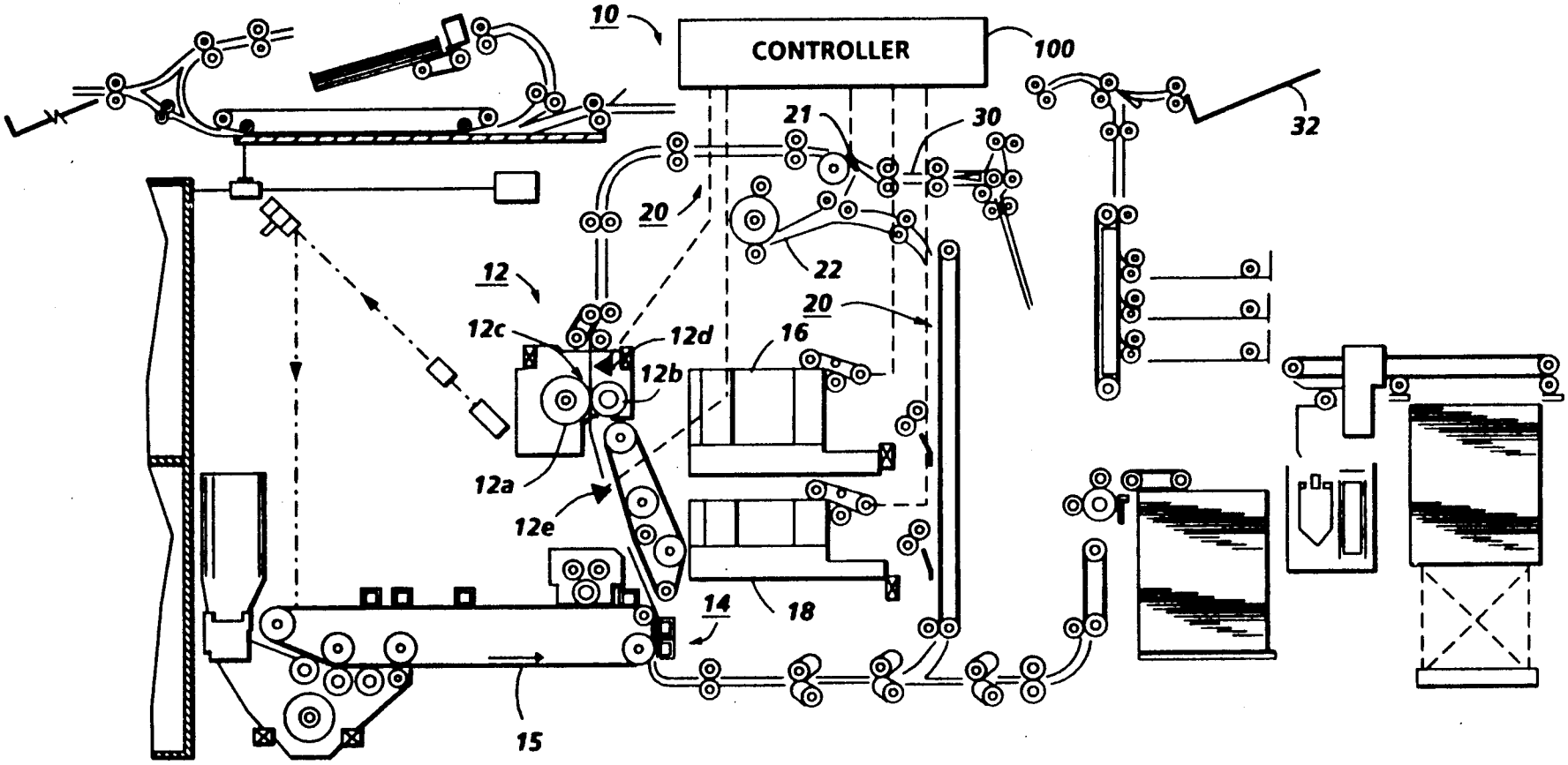

There is disclosed an improvement in electrostatographic or the like reproducing machines, and more particularly an improved system whereby the number of sheets used for a fuser clean-up purge process in a copier or printer can be substantially reduced by controlling purge sheets as if they were duplex copy sheets so as to route the purge sheets through an existing duplex paper path to use them twice, on both sides, to clean the fuser. This is preferably done automatically in the event of a paper jam event or other inadvertent stoppage of the reproducing machine, which can cause offsetting of imaging material to the fuser from an imaged cop sheet stopped in the fuser. The present system provides automatic cleaning of the fuser by automatically feeding a limited number clean-up or purge sheets through the fuser twice after such an event.

It has been known in the art a clean blank copy sheet through the fuser of a copier with a roll (contact) fuser to clean off toner therefrom and to purge or throw that sheet away, per se. See, e.g., IBM U.S. Pat. No. 3,706,491.

However, it is desirable to be able to do this automatically, i.e., without any operator intervention, yet with the minimum number of sheets which will effectively clean off the fuser roll, both to save wasted paper and to minimize the delay in normal copying for the purge cycle. Also, it is desired to do this as simple as possible, without requiring machine hardware changes, special machine cycles, or abnormal machine operations.

The prior art Xerox Corporation "5090" copier has an automatic post-jam purge cycle that feeds purge sheets at nonstandard abnormal feeding intervals (935 mc vs. 787 mc) (machine clocks) to accomplish its fuser clean-up purge operation with five (5) 8½" wide sheets. These are normally simplex path sheets. The "5090" also, in some situations, uses first-side-printed duplex copy sheets which were in the duplex tray before the machine stoppage for the fuser clean-up operation, when such sheets are available. (This can only be done when there are at least 5 sheets in the duplex tray when the jam occurs.) But, even then, these sheets are not routed through the duplex path during the fuser clean-up purge operation. The "5090" fuser clean-up purge sheets are never directed to the duplex tray — regardless of their origin. The "5090" treats the duplex tray as just another feeder. No sheets are ever passed through the fuser twice or reused on both sides in any "5090" fuser cleanup cycles. The "5090" performs this fuser clean-up purge after jams and other events which cause the machine to stop suddenly, e.g. opening a cover while the machine is running. The machine decides that fuser clean-up is required.

Of background art interest, as disclosing various copier job recovery and/or paper path jam recovery purge cycles in general, are U.S. Pat. Nos. 4,163,897 to Hubbard et al., 4,190,354 Smith et al., 4,206,996 to Clark et al., 4,327,993 to Gauronski et al., and commonly assigned U.S. application Ser. No. 07/589,613 filed Sep. 28, 1990 by the same Michael E. Farrell, et al., entitled "Printer Dynamic Job Recovery in an Electronic Reprographic Printing System".

By way of background as to the problem, most high speed copiers or printers use roll fusers to fuse the loose imaging material (toner powder) previously transferred to the copy sheets. These fusers usually comprise a heated fuser roll and an opposing pressure roll between which each copy sheet are passed (through the nip between the two rolls) so that the unfused imaging material is engaged by the hot fuser roll surface and fused to its copy sheet substrate. (See, e.g., U.S. Pat. No. 5,017,432 and art cited therein.) These rollers usually have an applied release agent, such as silicon oil, to avoid offsetting of toner onto the fuser roll. This is effective for sheets normally passing through the nip, i.e., which keep moving through the fuser nip without stopping.

However, if the copier or printer has a jam or failure requiring immediate or "hard" stopping of the copy sheet (paper) path, one of the copy sheets is likely to be stopped or stalled part way through the fuser nip. Various paper path faults or jams within the machine are among the most frequent reasons why this situation occurs. A fuser clean-up purge is desirably automatically performed promptly after these machine paper path stoppage situations, in response thereto, because toner can transfer from the stopped sheet onto the still-hot fuser roll when that sheet is held stationary in the fuser nip for any significant length of time. Any toner that is transferred onto the fuser roll in this manner can subsequently undesirably offset onto subsequent copy sheets upon restarting the copier or printer, printing undesirable dark marks or even partial images thereon. Thus, a copier or printer with a roll fuser desirably needs a fuser clean-up purge to be performed whenever the printer has stopped with an imaged sheet in the fuser nip. That is, a fuser clean-up purge is desirably automatically initiated after such a machine stoppage to prevent the fuser offset condition from affecting any subsequently fused sheets.

A fuser clean-up purge is desirably accomplished by contacting every point on the circumference of the fuser roll several times (preferably, a minimum of four times) with several clean sheets of un-imaged paper fed through the fuser nip, to capture any offsetting thereon and thus clean off the fuser. Then these purge or cleanup sheets are purged (preferably by being fed to a different output tray from that being used for regular or "good" copies). In effect, the machine automatically feeds through the fuser a predetermined number of sacrificial sheets of paper sufficient to blot up any toner which might be on that type of fuser roll after a machine stoppage. These purge sheets are desirably regular clean paper copy sheets fed automatically in a normal manner from an existing clean sheet paper tray or cassette of the reproducing apparatus. [Requiring special manual loading and feeding of special fuser cleaning sheets is obviously undesirable.]

However, performing such a desired fuser clean-up operation with normally fed normally scheduled simplex sheets wastes paper. In one exemplary known printing system, eight (8) sheets of normal letter size (8½" wide) paper (fed long-edge first, as it is in most high speed machines) may be required to contact every spot on the circumference of the fuser roll a desired four (4) times for that particular fuser. Ten (10) sheets are required in that exemplary printer if using 8" wise paper. Thus, there is a need to reduce the number of sheets used for the fuser clean-up purge operation.

As disclosed herein, the number of fuser clean-up purge sheets can be greatly reduced by treating the clean purge sheets as if they were duplex sheets, i.e., routing the purge sheets through the duplex loop after one pass through the fuser so as to feed the cleanup sheets through the fuser twice, with inversion of each sheet between its two cleanup passes through the fuser.

In this manner, in said one example, the number of letter size sheets consumed by the fuser clean-up purge operation was reduced from eight (8) to four (4).

Significant reductions in the number of purge sheets can be provided for other paper paths and other machines. This approach is easily implemented within various existing copier or printer software and hardware. It is particularly suitable for endless loop (trayless) duplex paths.

A specific disclosed feature of the specific embodiment disclosed herein is to provide an improved fuser cleaning purge cycle method of cleaning imaging material from a fuser of a copy reproducing apparatus after an inadvertent interruption of the operation of the apparatus, such as by a paper jam, in which the fuser was potentially contaminated with imaging material from a copy sheet being fused, wherein the reproducing apparatus has an alternative duplex copying path; comprising automatically, sequentially feeding a preset limited number of preexisting conventional clean copy sheets in the copy reproducing apparatus through the fuser to function as fuser cleaning sheets to remove the potentially contaminating imaging material, then feeding the same fuser cleaning sheets through the alternative duplex copying path back to and through the fuser a second time, with sheet inversion, so that they are inverted before feeding through the fuser the second time, and then purging these fuser cleaning sheets. This method is particularly suitable for cleaning a fuser roll of a roll fuser, wherein, preferably, every area of the circumference of a fuser roll is contacted by at lest one side of one fuser cleaning sheet a minimum of four times during this fuser cleaning cycle, yet with this disclosed method the present limited number of sheets used may be is four or less.

Another disclosed specific feature is that this fuser cleaning cycle may be automatically initiated in response to sensing that a copy sheet was stopped in the fuser during the interruption of the operation of the reproducing apparatus.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being copied in the copier onto the "copy sheet", which may be abbreviated as the "copy". A "simplex" document or copy sheet is one having its image and page number on only one side or face of the sheet, whereas a "duplex" document or copy sheet has "pages", and normally images, on both sides, i.e., each duplex document and copy is considered to have two opposing sides, faces, or "pages".

The disclosed apparatus may be readily operated and controlled in a conventional manner with conventional control systems. Some additional examples of various prior art copiers with control systems therefore, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying system utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc.

All reference cited in this specification, and their references, are incorporated by reference herein where appropriate for appropriate teachings of additional or alternative details, features, and/or technical background.

Figure 2:
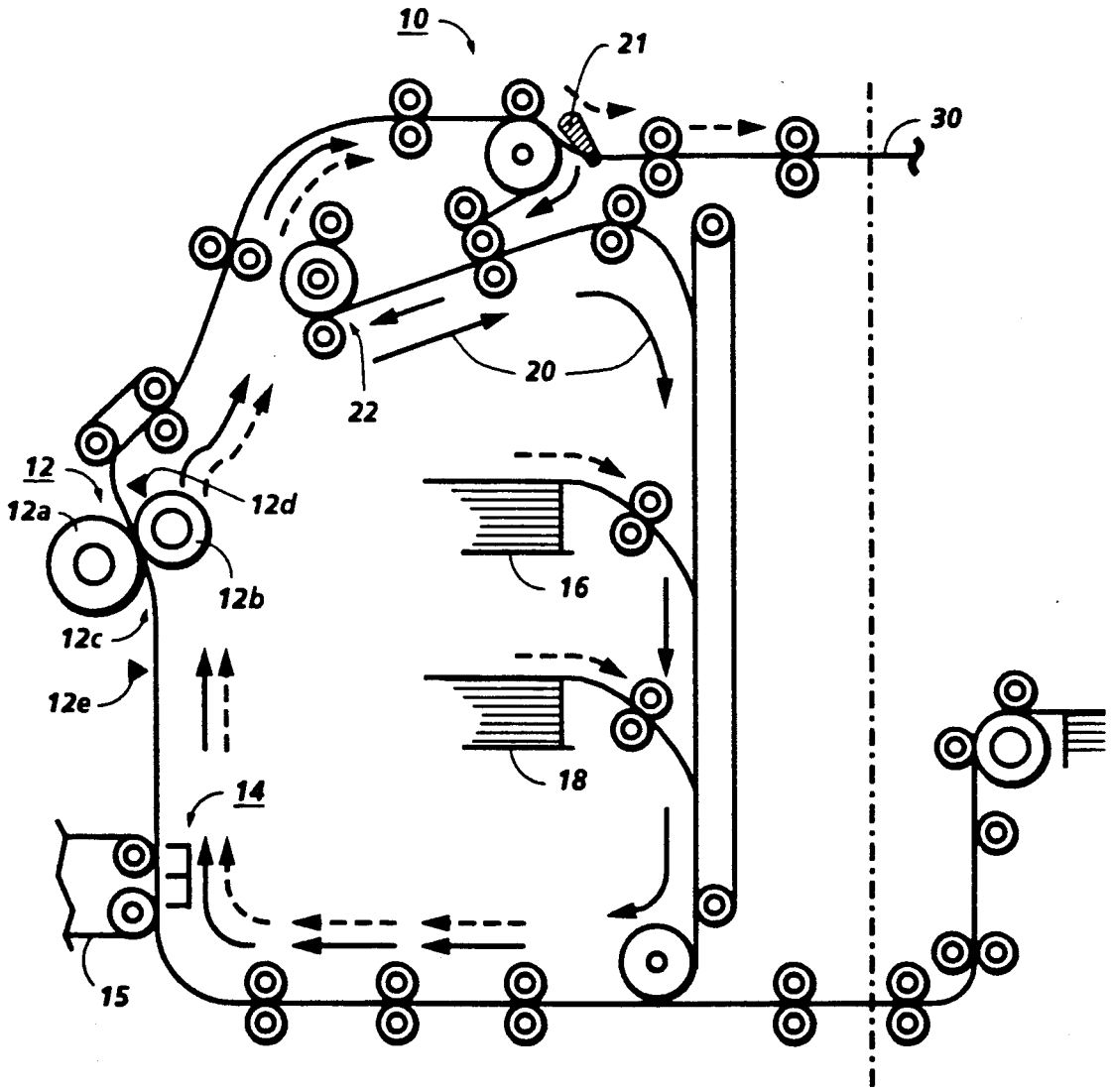

Various of the above-mentioned and further features and advantages will be apparent from the specific apparatus and its operation described in the example below, as well as the claims. Thus, the present invention will be better understood from this description of an embodiment thereof, including the drawing figures (approximately to scale) wherein:

FIG. 1 is a schematic side view of one embodiment showing one example of a printer in which the subject fuser cleanup purging system may be incorporated; and FIG. 2 is an enlarged view of the duplex loop path of FIG. 1.

Describing now in further detail this exemplary embodiment with reference to the Figures, there is schematically shown a duplex printer type reproducing machine 10 by way of one example of reproducing apparatus in which the subject fuser cleanup purging system may be utilized. This machine 10 is of a well known modern type (schematically, the Xerox Corporation "DocuTech" electronic printer). This illustrated basic paper path, especially the duplex path 20 and its operation, is also shown, and further described, in a commonly assigned allowed U.S. application Ser. No. 07/590,236 filed Sep. 28, 1990 by the same Michael E. Farrell, et al., entitled "Methods for Sheet Scheduling in An Imaging System Having An Endless Duplex Paper Path Loop". This duplex paper path 20 is similar to that of the Xerox Corporation "1075" and "1090" and "5090" copiers and the numerous patents thereon, such as U.S. Pat. Nos. 4,278,344 or 4,782,363, with the exception of the replacement in the machine 10 duplex path 20 of the prior duplex buffer sheet stacking tray with a direct, one sheet, inverter 22 to form an endless loop duplex path.

This exemplary machine 10 has a conventional roll fuser 12 (note, e.g., the above-cited U.S. Pat. No. 5,017,432 and art cited therein) with a heated fusing roll 12*a* and pressure roll 12*b* forming fusing nip 12*c* for fusing the last imaged side of copy sheets fed from a transfer station 14 in which an unfused toner image from a photoreceptor 15 is applied to one side of copy sheets. The sheets are initially fed to the transfer station 14 via the paper path from a choice of clean copy sheet feeding trays 16 or 18. As discussed above, the copy sheet paper path includes the duplex path 20, into which copies printed on one side can by gate 21 be diverted from the normal simplex output path 30 and inverted in an inverter 22 and returned back to the transfer station 14 via a duplex loop path for second side imaging and fusing (duplexing) before being outputted in the normal simplex output path 30.

It will be appreciated that this is only one example, and that suitable alternative duplex paths are also well known, such as in Xerox Corporation U.S. Pat. Nos. 4,949,949 or 4,928,128 or 4,708,462 or 4,459,013.

When the printer 10 has a jam, fault or failure, conventionally sensed by paper path sensors, which is determined by the machine controller 100 to require immediate or "hard" stopping of the copy sheet (paper path) drives, one of the copy sheets in close sequential processing in the paper path is very likely to be stopped or stalled part way through the fuser 12, fusing nip 12*c* in this situation. A fuser clean-up purge cycle is desirably automatically initiated by controller 100 in response to this "hard" stop jam condition signal and the subsequent jam clearance and restart signals, to be performed substantially immediately after normal jam clearance. Upon restart, and prior to starting the fuser clean-up purge, the control system performs a jam clearance purge cycle to ensure that the paper path is empty. Once the paper path is determined to be emptied out, the control system can initiate the fuser clean-up purge without cycling down the paper path again. Since it is difficult to directly sense the presence of sheets left in the fuser nip, preferably the control system determines whether or not a fuser clean-up is required by comparing the values in two counters after every machine shutdown. The number of sheets departing the post-fuser sensor 12*d* is compared to the number of sheets arriving at a pre-fuser paper path sensor such as 12*e*. If these two sheet counter values are unequal, the control system infers that some portion of a sheet has been left in static contact with the fuser roll.

This purge cycle is needed because toner is likely to have transferred from the stopped sheet onto the still-hot fuser roll 12*a* as that sheet was held stationary in the fuser nip 12*c* during the jam stop (before that sheet is removed during the jam recovery). Thus, the roll fuser 12 needs a fuser clean-up purge to be performed whenever this "hard" stop jam condition has occurred. (As opposed to a "soft" stop, in which the fuser 12 can continue to be rotatably driven briefly after the jam signal so that a sheet in the fuser can be fed out before stopping the machine.) Otherwise, toner transferred onto the fuser roll 12*a* from a sheet stopped in nip 12*c* can subsequently undesirably offset onto subsequent copy sheets upon restarting the machine 10. That would print undesirable dark marks or partial images on those subsequent copy sheets. The fuser clean-up purge cycle prevents the fuser offset condition from affecting any subsequently fused sheets, i.e., otherwise good copy sheets.

This fuser cleanup is preferably done by contacting the entire circumference of the fuser roll several times with several clean sheets of un-imaged paper (called purge sheets) which are fed from the clean sheet paper trays 16 or 18 through the fuser nip 12*c*. These fuser cleanup purge sheets capture fuser toner offset on the fuser roll by picking it up on the purge sheets in the nip 12*c*, and thus clean off the fuser 12 as they pass through it. Then these purge or cleanup sheets continue on through the paper path to be purged. That is, they are then ejected from the machine 10, such as into a tray 32 distinct from the normal finisher output. i.e., preferably the used purge sheets are fed to a different output tray from that being used for regular or "good" copies. In effect, the machine automatically, instructed by controller 100, feeds through the fuser 12 a predetermined number of sacrificial sheets of paper sufficient to blot up any toner which might be on that type of fuser roll after a machine stoppage.

This is the fuser cleanup purge cycle. It is not a copying cycle. The regular imaging or image development system is disabled or inhibited during this fuser cleanup purge cycle so as not to transfer any toner images to the purge sheets. Nor is this fuser cleanup purge cycle to be confused with the [preceding jam clearance purge cycle, although there may be some partial overlap therewith, if desired. [A jam clearance purge cycle, for purging of damaged or undesired copy sheets from the paper path after sheet jam or misfeed sensing, is well known, e.g., U.S. Pat. Nos. 3,778.051 Col. 3 middle; 3,936,180 Col. 4–5; 4,231,567; 4,750,020; and 5,072,923.]

It has been found preferable, for roll fuser 12, for every area of the circumference of the fuser roll 12*a* to be so contacted by a clean purge sheet area a minimum of four (4) times during the cleanup purge cycle to insure full fuser cleanup. But since there is a requisite regular spacing (time gap, or pitch) between sheets in the copy path of a reproducing machine, this cannot normally be done with only four purge sheets. Heretofore, the machine 10 required eight sheets of normal letter size (8½" wide) paper (fed long-edge first, as in most high speed machines) to insure that all areas of the fuser roll 12*a* were contacted by a clean purge sheet area a minimum of four times. This wasted paper and time.

The present system substantially reduced the number of sheets needed for this fuser clean-up purge operation, with a simple control or software modification not requiring any hardware additions or changes. Specifically, the number of fuser clean-up purge sheets was greatly reduced by treating the clean purge sheets as if they were duplex sheets, i.e., routing the purge sheets through the duplex loop 20 after their first pas through the fuser 12 so as to feed the same purge sheets back through the fuser 12 a second time, with inversion of each purge sheet by the inverter 22 between its two cleanup passes through the fuser 12. Thus, both sides of the purge sheets are used to engage the fuser roll 12*a*. To accomplish this, the controller 100 need only actuate the duplex path 20 diverter gate 21 during the first half of a purge cycle, e.g., until after the fourth purge sheet has passed through the diverter gate 21. In this manner, in this example, the number of letter size sheets consumed by the fuser clean-up purge operation was reduced from eight to four.

The present system can use standard or existing duplex sheet scheduling processes and software. It can use standard, existing, techniques for scheduling and routing purge sheets. The software base nodes only need to inform the job manager that fuser clean-up is needed. The software scheduling can be managed entirely within the existing job manager node.

Even if larger copy sheet paper is used, e.g., 11"×17", in a 3 pitch mode, duplexing of fuser cleanup sheets still reduces the number of sheets required. When running 11"×17" paper, fuser cleanup purge may be done with only two duplex sheets (vs. 3 simplex sheets). This technique is not specific or limited to one standard paper size.

Although this concept is shown here applied specifically to fuser clean-up purging, it could also be applied to some other sheet purges required by other subsystems of paper paths of reproducing apparatus.

As to suitable specific hardware components of the exemplary apparatus, it will be appreciated that, as is normally the case, such hardware components are known per se in this and other apparatus or applications, such as is disclosed in the above-cited and other patents and products.

While the embodiment disclosed herein is preferred, it will be appreciated from this teaching that various alternatives, modifications, variations or improvements therein may be made by those skilled in the art, which are intended to be encompassed by the following claims.

What is claimed is:

1. An improved method of cleaning imaging material from a fuser of a copy reproducing apparatus in a fuser cleaning purge cycle after an inadvertent interruption of the operation of said reproducing apparatus in which said fuser was potentially contaminated with imaging material from a copy sheet being fused, wherein said reproducing apparatus has an alternative duplex copying path, comprising:

automatically sequentially feeding a preset limited number of preexisting conventional clean copy sheets in said copy reproducing apparatus through said fuser to function as fuser cleaning sheets to remove said potentially contaminating imaging material from said fuser, then feeding said same fuser cleaning sheets through said alternative duplex copying path of said reproducing apparatus back to and through said fuser a second time, with sheet inversion, so that these fuser cleaning sheets are inverted before said feeding through said fuser said second time, and then purging said same fuser cleaning sheets, to complete said fuser cleaning purge cycle, wherein said fuser cleaning purge cycle is automatically initiated in response to sensing that a copy sheet was stopped in said fuser during said interruption of the operation of said reproducing apparatus.

2. The method of claim 1, wherein said preset limited number of preexisting conventional clean copy sheets used as fuser cleaning sheets in said fuser cleaning purge cycle is four or less sheets.

3. An improved method of cleaning imaging material from a fuser of a copy reproducing apparatus in a fuser cleaning purge cycle after an inadvertent interruption of the operation of said reproducing apparatus in which said fuser was potentially contaminated with imaging material from a copy sheet being fused, wherein said reproducing apparatus has an alternative duplex copying path, comprising:

automatically sequentially feeding a preset limited number of preexisting conventional clean copy sheets in said copy reproducing apparatus through said fuser to function as fuser cleaning sheets to remove said potentially contaminating imaging material from said fuser, then feeding said same fuser cleaning sheets through said alternative duplex copying path of said reproducing apparatus back to and through said fuser a second time, with sheet inversion, so that these fuser cleaning sheets are inverted before said feeding through said fuser said second time, and then purging said same fuser cleaning sheets, to complete said fuser cleaning purge cycle;

wherein said preset limited number of preexisting conventional clean copy sheets used as fuser cleaning sheets in said fuser cleaning purge cycle is four or less sheets;

wherein said fuser has a fuser roll, and every area of the circumference of the fuser roll is contacted by said fuser cleaning sheets a minimum of four times during said fuser cleaning purge cycle; and wherein said fuser cleaning purge cycle is automatically initiated in response to sensing that a copy sheet was stopped in said fuser during said interruption of the operation of said reproducing apparatus.

* * * * *